US006938424B2

(12) United States Patent
Tiemann

(10) Patent No.: US 6,938,424 B2
(45) Date of Patent: Sep. 6, 2005

(54) ANNULAR COMBUSTION CHAMBERS FOR A GAS TURBINE AND GAS TURBINE

(75) Inventor: Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 47 days.

(21) Appl. No.: 10/672,510

(22) Filed: Sep. 26, 2003

(65) Prior Publication Data

US 2004/0074239 A1 Apr. 22, 2004

(30) Foreign Application Priority Data

Oct. 21, 2002 (EP) ..... 02023471

(51) Int. Cl.[7] ..... F02C 7/00
(52) U.S. Cl. ..... 60/752; 60/798
(58) Field of Search ..... 60/752, 753, 755, 60/757, 758, 760, 804, 798

(56) References Cited

U.S. PATENT DOCUMENTS

| | | | | |
|---|---|---|---|---|
| 4,236,378 A | | 12/1980 | Vogt | |
| 4,614,082 A | | 9/1986 | Sterman et al. | |
| 4,628,694 A | * | 12/1986 | Kelm et al. | 60/752 |
| 5,113,660 A | | 5/1992 | Able et al. | |
| 2002/0056277 A1 | | 5/2002 | Parry | |

FOREIGN PATENT DOCUMENTS

| | | |
|---|---|---|
| DE | 43 09 200 | 9/1994 |
| GB | 647293 | 12/1950 |
| GB | 1 450 894 | 9/1976 |
| JP | 57 124 620 | 3/1982 |

* cited by examiner

*Primary Examiner*—Ehud Gartenberg

(57) ABSTRACT

The invention relates to an annular combustion chamber for a gas turbine wherein the annular combustion chamber extends in an axial direction, encloses a combustor and has on its inside facing the combustor a bearing structure on which a lining element secured to this lines the annular combustion chamber. The object is to disclose an annular combustion chamber with a lining element that meets the mechanical requirements while at the same time taking account of the system's maintenance-friendliness. The object is achieved in that the annular combustion chamber has a lining element wherein on the rear side facing away from the combustor of two edge areas on the lining element a plurality of interlocking means are located which have a hook width and wherein the lining element is secured to the corresponding bearing structure such that in order to release the lining element from the bearing structure the lining element is moved by the extent of the hook width of the interlocking means in the axial direction.

19 Claims, 4 Drawing Sheets

ANNULAR COMBUSTION CHAMBERS FOR A GAS TURBINE AND GAS TURBINE

CROSS REFERENCE TO RELATED APPLICATIONS

This application claims priority to the European application No. 02023471.2 EP, filed Oct. 21, 2002 under the European Patent Convention and which is incorporated by reference herein in its entirety.

1. Field of the Invention

The invention relates to an annular combustion chamber for a gas turbine wherein the annular combustion chamber extends in an axial direction, encloses a combustor, and has on its inside facing the combustor a bearing structure having a lining element secured to the bearing structure and lines the annular combustion chamber.

2. Background of the Invention

Gas turbines are nowadays often used to convert fossil energy in conjunction with a generator into electrical energy. The means of combustion is mixed with compressed air and routed to a combustor and combusted. The resulting working medium flows along a hot gas channel past several turbine stages. Each turbine stage consists of a plurality of guide vanes and rotor blades arranged separately in two rings. The guide vanes are secured to a fixed stator and the rotor blades to a rotor driving the generator. The combustor is located in a combustion chamber lined with heat-resistant lining elements.

Lining elements of a combustion chamber according to the invention are liners. Other components delimiting the combustor are located in a combustion chamber and are exposed to the hot gas. As is known, the combustion chamber is lined by a plurality of lining elements that are mutually adjacent in the axial direction and in the circumferential direction of the turbine shaft.

A liner is known from U.S. Pat. No. 4,614,082. Shown there in FIG. 2 is a combustion chamber which has a plurality of liners, with the adjacent liners overlapping such that the end of the front liner, as viewed in the direction of flow of the working medium, overlaps the start of the following liner. This also applies to the liners succeeding in the direction of flow of the working medium, which thus form a series of overlapping liners. A liner's necessary rigidity with respect to the conditions prevailing in the combustor is provided by means of a sidewall that runs in the circumferential direction and extends across the entire width of the liner. This sidewall of the liner is located at the rear side facing away from the hot gas. It proceeds away from this and turns off along its further course in the axial direction so that it extends behind adjacent liners.

It is further known that annular combustion chambers cooled by means of a closed-circuit arrangement are fitted with liners which are provided on their rear side facing away from the hot gas with sidewalls running in the axial direction. The liners per se are very rigid owing to their sidewalls, which is necessary due to conditions in the combustor. The rails located within the annular combustion chamber that support the liners can consequently be of less rigid design.

The arrangement of adjacent liners known from U.S. Pat. No. 4,614,082 has the disadvantage that maintenance work carried out on the liners can be very costly when one of the liners located at the back in the direction of flow has to be replaced. In this case it is necessary to dismantle all the liners in a series located in front of the liner being replaced.

Intrinsic rigidity of the liner is also provided by the sidewall. This rigidity, in conjunction with the fluctuations in temperature associated with the start-up of the gas turbine, with operation, and with powering-down, gives rise to distortions between the bearing structure and liner which make it difficult to detach the lining element from the annular combustion chamber. It must further be noted that the lining elements must withstand the static and dynamic pressures prevailing in the combustor.

The underlying object of the invention is to disclose an annular combustion chamber whose lining elements are rigid and are securedly fixed to the annular combustion chamber while at the same time being easy to maintain. A further object of the invention is to disclose a maintenance-friendly gas turbine.

To achieve this object, an annular combustion chamber with a lining element is disclosed wherein on the rear side facing away from the combustor are two edge areas extending in the axial direction. A plurality of interlocking means are located on the lining element and have a hook width in the axial direction. The lining element is secured to the corresponding bearing structure such that in order to release the lining element from the bearing structure this element is moved by the extent of the hook width of the interlocking means in the axial direction.

The selected arrangement, form, and placement of the interlocking means of the lining element allow an individual lining element to be easily mounted. The lining element itself has an axial softness owing to the plurality of mutually spaced interlocking elements. In the non-mounted condition, this softness is determined only by the wall thickness of the lining element. Alongside the relatively short movement path corresponding to the width of an interlocking means, the axial softness of the lining element helps to facilitate assembly and dismantling and to make this secure. The lining element mounted on the rigid and fixed bearing structure assumes the rigidity of this structure. The rigidity of the lining element necessary for operating the gas turbine is then provided in the assembled condition.

The axial softness of the lining element helps advantageously to ensure that the distortions between the bearing structure and lining element, usually present in the assembled condition owing to thermal stresses, do not occur. Consequently, minimal force is required to dismantle a lining element according to the invention.

A lining element can at the same time be mounted and dismantled independently of lining elements adjacent to the turbine shaft in the axial and circumferential direction.

In an advantageous embodiment of the invention, a plurality of further interlocking means are located as a central support midway between two edge areas of the lining element extending in the axial direction. A coolant, such as cooling air or cooling steam and has higher pressure than the working medium customarily flows between the combustion chamber and the rear side of the lining element facing away from the hot gas. The higher pressure of the coolant on the rear side of the lining element facing the working medium may cause deformation of the lining element toward the working medium. This deformation is reduced to within tolerable limits by reducing the bridged span between the two edge areas in the circumferential direction by further interlocking means arranged centrally. The centrally arranged interlocking means can have identical or similar profiles to the interlocking means of the edge areas, or profiles that substantially differ.

The advantageous feature that two interlocking means of the lining element that are immediately adjacent in the axial direction have is a spacing which is identical to or greater than the hook width of the interlocking means and allows the mounted lining element to be removed after being moved by the extent of this hook width. Each interlocking means has an identical hook width in the interest of easy manufacture and handling.

In an advantageous development of the invention, two interlocking means of the lining element that are immediately adjacent in the axial direction have a spacing which is twice the hook width of an interlocking means.

Two interlocking means of the lining element that are immediately adjacent in the axial direction preferably have a spacing which is three times the hook width of an interlocking means.

The spacing between two interlocking means of the lining element that are immediately adjacent in the axial direction is preferably identical in each case. Manufacture of the lining element is simplified by a symmetrical and uniform design for frequently used elements such as interlocking means.

According to an advantageous embodiment of the invention, the lining element has stiffening ribs extending in the circumferential direction of the annular combustion chamber on its rear side facing away from the combustor. These ribs increase the rigidity of the lining element. Unintentional bowing of the lining element in the radial direction can consequently be reduced or may be avoided.

The stiffening ribs are preferably distanced from the interlocking means. Local bending points are located on account of this between the ends of the stiffening ribs and the interlocking elements. The stiffening ribs ensure rigidity of the lining element in the central area between the opposite interlocking means in the circumferential direction, with the local bending points facilitating installation and removal of the lining element. The distortions occurring between the bearing structure and lining element due to thermal stress have no negative impact on the dismantling of the lining element, meaning it is not necessary to apply greater force for dismantling.

The interlocking elements are preferably L-shaped and/or T-shaped. Other forms of interlocking elements are also suitable for the lining elements. For example, spherical or conical or truncated conical and similar interlocking elements such as a bayonet will achieve the same object.

The object relating to the gas turbine is achieved by means of a gas turbine with an annular combustion chamber according to one of the above embodiments.

BRIEF DESCRIPTION OF THE DRAWINGS

The invention is described in greater detail in an exemplary manner with the aid of the drawings, in which.

DETAILED DESCRIPTION OF THE INVENTION

Figure 1:
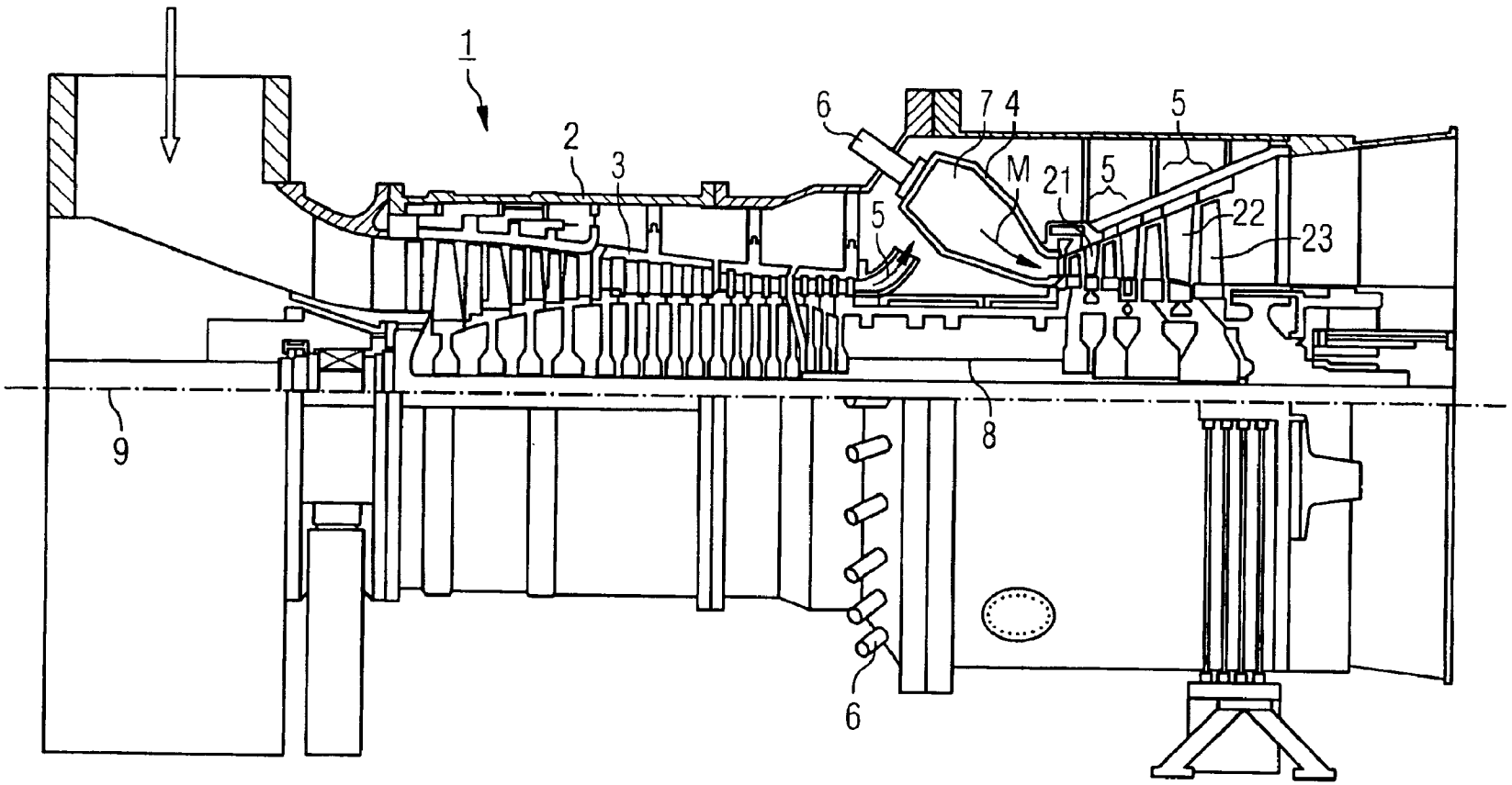
FIG. 1 shows a longitudinal section through a gas turbine.

FIG. 1 shows a gas turbine 1 with a casing 2, a compressor 3, an annular combustion chamber 4, and several turbine stages 5 connected downstream of the annular combustion chamber 4. The air taken in by the compressor 3 is compressed in this and then forwarded to a burner 6. The compressed air is mixed there with a means of combustion and, on being injected into a combustor 7 located in the annular combustion chamber 4, is combusted to produce a working medium M. The working medium M then flows through a hot gas channel 21 past the turbine stages 5 each formed from a plurality of guide blades 22 and rotor blades 23 arranged separately in two rings. The energy of the working medium M is converted into rotational energy by means of the rotor blades 23 located on a rotor 8 mounted so it can rotate around the axis of rotation 9.

Figure 2:
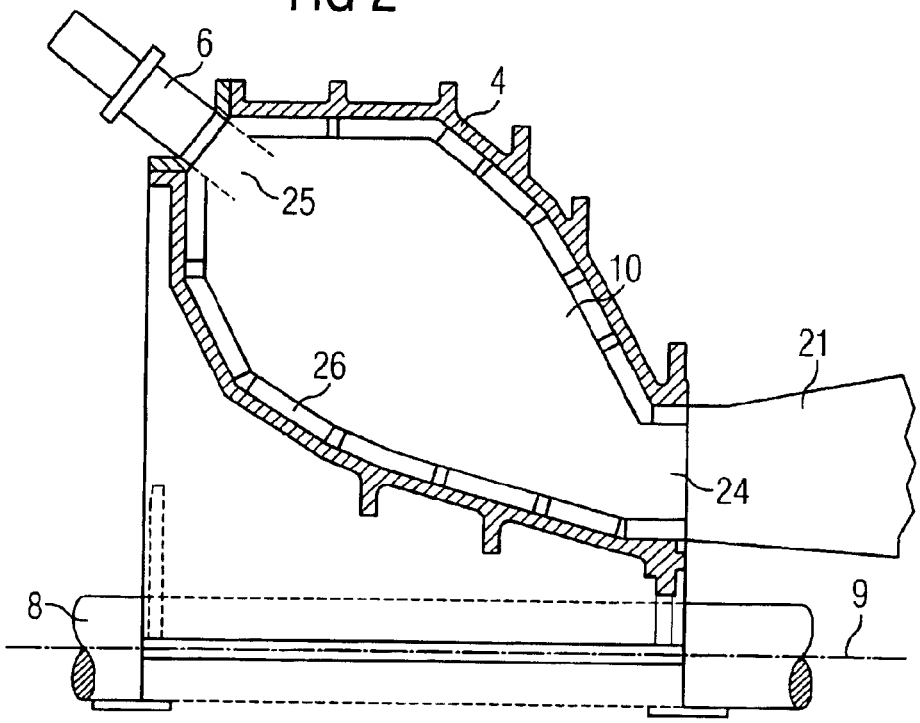
FIG. 2 shows a longitudinal section through an annular combustion chamber.

FIG. 2 shows a cross-section of an annular combustion chamber 4. The lower section of the annular combustion chamber 4 is not shown for reasons of symmetry, so that only the top section of the annular combustion chamber 4 extending circularly around the axis of rotation 9 of the rotor 8 is shown. At its discharge end 24 facing the hot gas channel 21 the annular combustion chamber 4 is open toward this channel. The burner 6 is located at the injection end 25 of the annular combustion chamber 4 opposite the discharge end 24 facing the hot gas channel 21. Between the injection end 25 and the discharge end 24 of the annular combustion chamber 4, this is lined with a plurality of mutually adjacent lining elements 10 which are secured to a bearing structure 26.

Figure 2A:
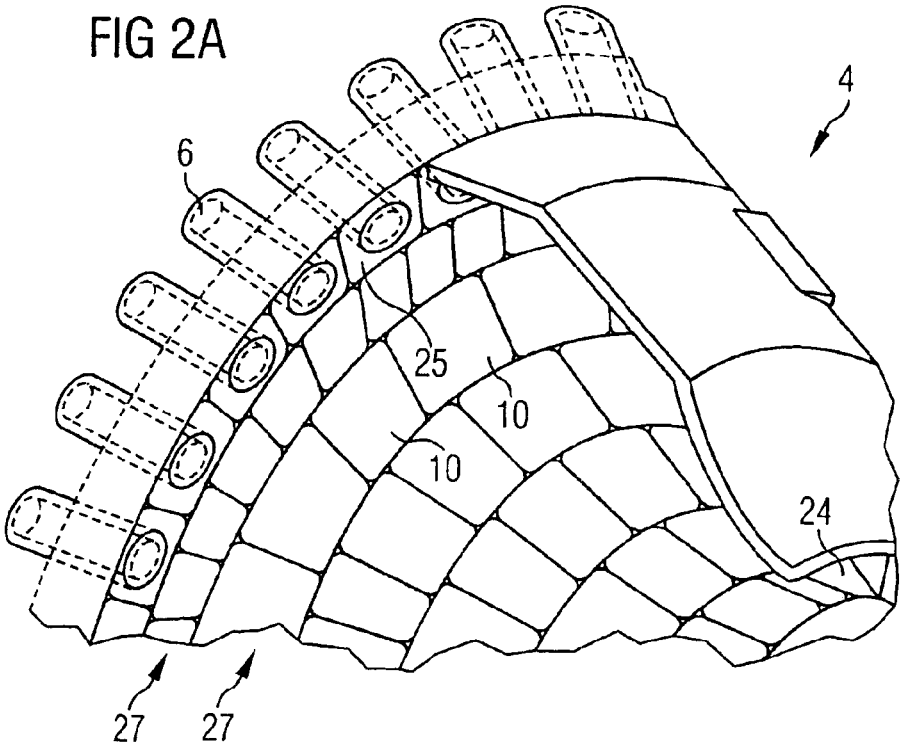
FIG. 2*a* shows a perspective view of a section of an annular combustion chamber.

FIG. 2*a* shows a perspective view of an annular combustion chamber 4 which is partially opened on the outside to be more easily describable. The annular combustion chamber 4 is lined with a plurality of lining elements 10 located circularly 27 in the circumferential direction U.

Figure 3:
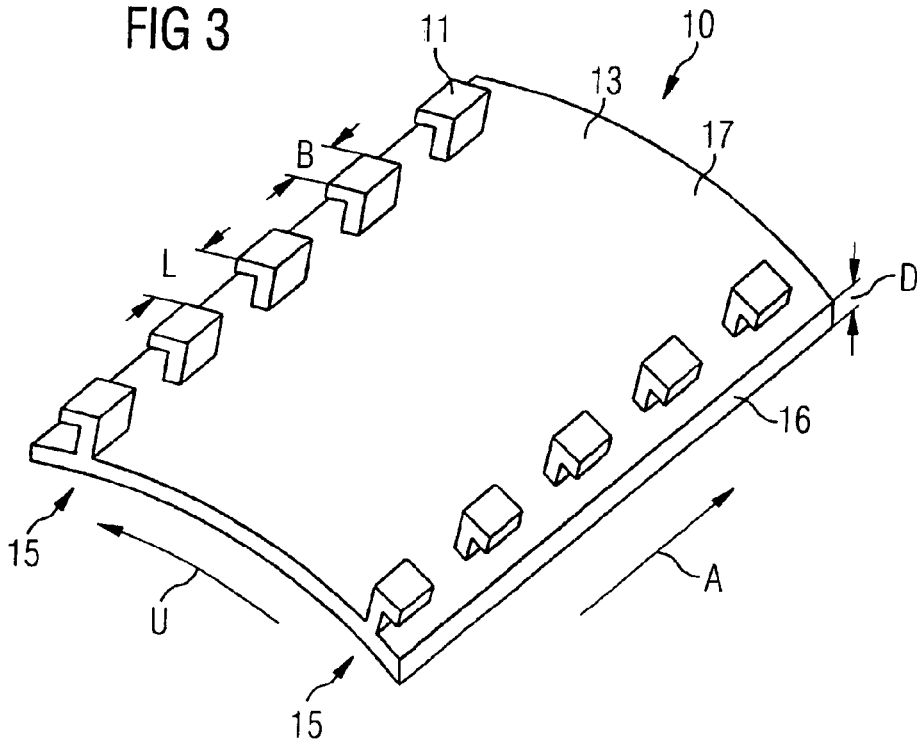
FIG. 3 shows a lining element for an annular combustion chamber.

FIG. 3 shows a lining element 10 which has a plurality of interlocking means 11 on the rear side 13 facing away from the hot gas. These interlocking means 11 are located in the two edge areas 15 of the lining element 10 running in the axial direction A. Each interlocking means 11 has a width B. The interlocking means 11 are essentially L-shaped. They protrude from the rear side 13 of the lining element 10 and, in their further course, bend at right angles to the nearest side edge 16 of the lining element 11 running in the axial direction. The spaces between two immediately adjacent interlocking means 11 are referenced with L.

The lining element 10 is secured to the corresponding bearing structure 26 of an annular combustion chamber 4 by being introduced into a recess of the bearing structure 26 accommodating the interlocking means 11 and moved by the extent of the width B until the interlocking means 11 have fully engaged with the bearing structure 26. The interlocking means 11 of the lining element 10 and the bearing structure 26 are then securely interlocked into position.

Figure 4:
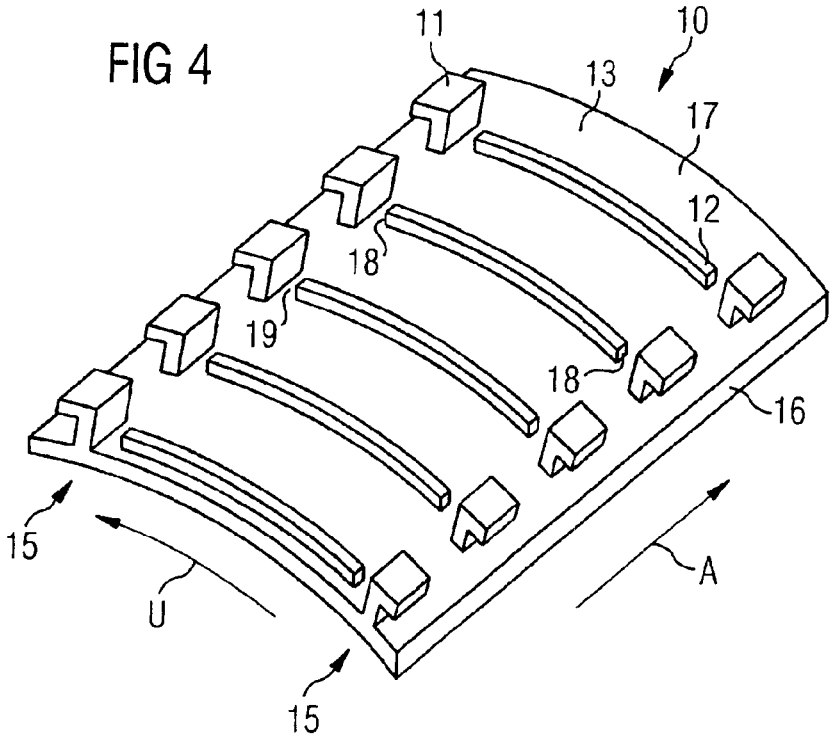
FIG. 4 shows a lining element with stiffening ribs for an annular combustion chamber.

FIG. 4 shows a lining element 10 which has stiffening ribs 12 on the rear side 13 facing away from the hot gas. The stiffening ribs 12 extend in the circumferential direction U and are at a distance from the interlocking means 11. The stiffening ribs 12 reduce bowing of the lining wall 17 when the gas turbine 1 is operating. The ends 18 of the stiffening ribs 12 are spaced at a distance from the interlocking elements 11 such that local bending points 19 produce slight local softness there which facilitates installation and removal of the lining element 10.

Figure 5:
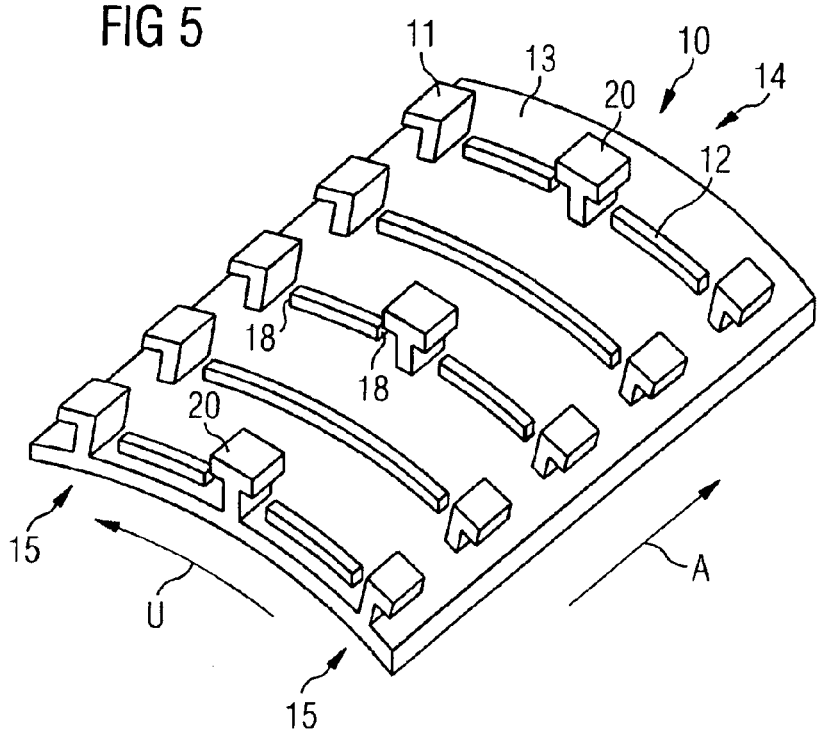
FIG. 5 shows a lining element with a rib support and stiffening ribs.

A lining element 10 which has a so-called central support 14 on the rear side 13 facing away from the hot gas is shown in FIG. 5. The central support 14 consists of further, individual interlocking elements 20 which, viewed in the circumferential direction U, are located centrally between two interlocking elements 11 located in different edge areas 15. This central support 14 reduces bowing of the lining wall 17 during operation by reducing the span between the edge areas 15, thereby contributing to the rigidity. The further interlocking means 20 are essentially T-shaped. They protrude from the rear side 13, then bend away tangentially to the circumferential direction U in two arms.

Figure 6:
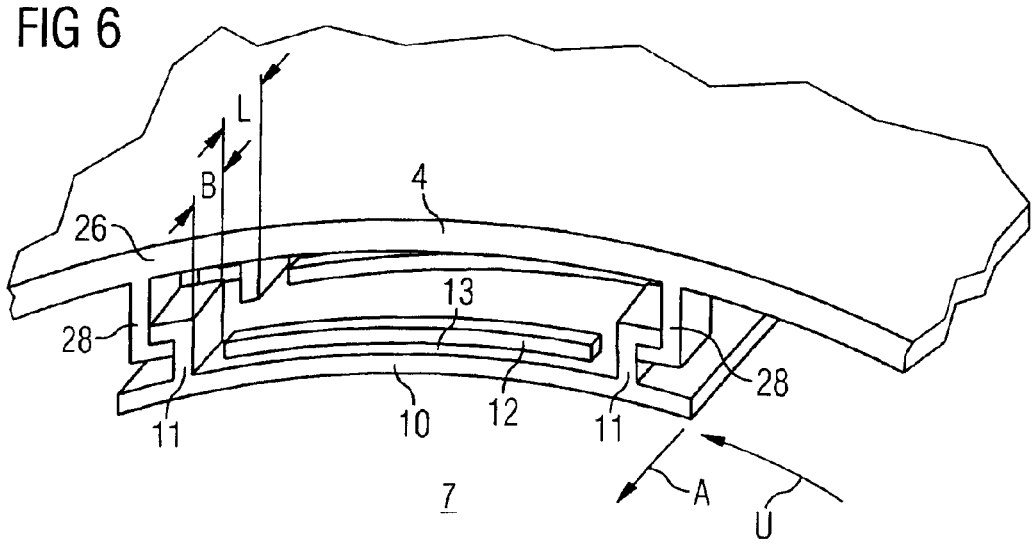
FIG. 6 shows a lining element with bearing structure.

FIG. 6 shows a section through an annular combustion chamber 4 to which a lining element 10 is secured. Located on the side of the annular combustion chamber 4 facing the combustor 7 is the bearing structure 26. This has interlocking means 28 embodied correspondingly to those of the lining elements 10. The interlocking means 11 of the lining element 10 interlock with the corresponding interlocking means 28 of the bearing structure 26. The width B of an interlocking element 11 is here less than the space L between two adjacent interlocking elements 11. The interlocking means 28 of the bearing structure 26 also have a mutual spacing corresponding at least to the width of the interlocking elements 11 of the lining element 10. Stiffening ribs 12 running in the circumferential direction U are located on the rear side 13 of the lining element 10 facing away from the combustor 7.

The lining element 10 is released from the bearing structure 26 by moving the lining element 10 at least by the extent of the width B on an interlocking means 11 in or opposite the axial direction A.

The securing mechanism consisting of the interlocking elements 11 of the lining element 10 and the corresponding bearing structure 26 can have relatively large component tolerances. Over-dimensioning of the lining element 10 referred to the corresponding bearing structure 26 poses no problems as the axial softness, in conjunction with the local bending 19 located in the circumferential direction U, will compensate any over-dimensioning of the lining element 10.

I claim:

1. An annular combustion chamber for a gas turbine extending in the axial direction, comprising:

a combustor enclosed by the combustion chamber;

a bearing structure arranged on the inside of the combustion chamber and facing the combustor;

a lining element having a rear side facing away from the combustor and having two edge areas extending in the axial direction, each said edge area being secured to the bearing structure that lines the annular combustion chamber by and a plurality of interlocking devices separated by a plurality of axial spacing having a width arranged on the lining element such that in order to release the lining element from the bearing structure the lining element is moved by the extent of the width of the interlocking devices in the axial direction, wherein two interlocking devices of the lining element that are immediately adjacent in the axial direction have an axial spacing which is identical to or greater than the width of the interlocking devices.

2. The annular combustion chamber according to claim 1, wherein a further plurality of interlocking devices are located as a central support midway between two edge areas of the lining element running in the axial direction.

3. The annular combustion chamber according to claim 1, wherein each interlocking device has the identical hook width.

4. The annular combustion chamber according to claim 1, wherein two interlocking devices of the lining element that are immediately adjacent in the axial direction have an axial spacing which is twice the width of an interlocking device.

5. The annular combustion chamber according to claim 1, wherein two interlocking devices of the lining element that are immediately adjacent in the axial direction have an axial spacing which is three times the width of an interlocking device.

6. The annular combustion chamber according to claim 4, wherein each spacing between two interlocking devices of the lining element that are immediately adjacent in the axial direction is identical.

7. The annular combustion chamber according to claim 1, wherein the lining element has stiffening ribs running in the circumferential direction of the annular combustion chamber on its rear side facing away from the combustor.

8. The annular combustion chamber according to claim 7, wherein the stiffening rib is distanced from the interlocking devices.

9. The annular combustion chamber according to claim 1, wherein the interlocking devices are L- and/or T-shaped.

10. A gas turbine with an annular combustion chamber wherein the combustion chamber comprises:

a combustor enclosed by the combustion chamber;

bearing structure arranged on the inside of the combustion chamber and facing the combustor;

a lining element having a rear side facing away from the combustor and having two edge areas extending in the axial direction, each said edge area being secured to the bearing structure that lines the annular combustion chamber by and a plurality of interlocking devices separated by a plurality of axial spacings having a width arranged on the lining element such that in order to release the lining element from the bearing structure the lining element is moved by the extent of the width of the interlocking devices in the axial direction, wherein two interlocking, devices of the lining, element that are immediately adjacent in the axial direction have an axial spacing which is identical to or greater than the width of the interlocking devices.

11. A combustion chamber for a gas turbine, comprising:

a combustor enclosed by the combustion chamber;

a bearing structure arranged on the inside of the combustion chamber and facing the combustor;

a lining element having a rear side facing away from the combustor and having two edge areas extending in the axial direction, each said edge area being secured to the bearing structure that lines the annular combustion chamber by and a plurality of interlocking devices separated by a plurality of axial spacing having a width arranged on the lining element such that in order to release the lining element from the bearing structure the lining element is moved by the extent of the width of the interlocking devices in the axial direction, wherein two interlocking devices of the lining element that are immediately adjacent in the axial direction have an axial spacing which is identical to or greater than the width of the interlocking devices.

12. The annular combustion chamber according to claim 11, wherein the interlocking devices face away from the combustor.

13. The annular combustion chamber according to claim 11, wherein the interlocking device is a hook.

14. The annular combustion chamber according to claim 11, wherein the width is the hook width.

15. The annular combustion chamber according to claim 1, wherein the interlocking device is a hook.

16. The annular combustion chamber according to claim 1, wherein the width is the hook width.

17. The annular combustion chamber according to claim 2, wherein two interlocking devices of the lining element that are immediately adjacent in the axial direction have an axial spacing which is identical to or greater than the hook width of the interlocking devices.

18. The annular combustion chamber according to claim 2, wherein each interlocking device has the identical hook width.

19. The annular combustion chamber according to claim 2, wherein two interlocking devices of the lining element that are immediately adjacent in the axial direction have an axial spacing which is twice the hook width of an interlocking device.

* * * * *